United States Patent [19]

Yamano et al.

[11] 4,027,194

[45] May 31, 1977

[54] CORE MAGNETRON MAGNETIC CIRCUIT HAVING A TEMPERATURE COEFFICIENT APPROXIMATELY ZERO AND PERMEANCE RELATED

[75] Inventors: Masaru Yamano, Hirakata; Toshio Iemura, Kyoto, both of Japan

[73] Assignee: Sanyo Electric Co., Ltd., Japan

[22] Filed: Oct. 28, 1975

[21] Appl. No.: 626,056

[30] Foreign Application Priority Data

Oct. 25, 1974 Japan ..... 49-123520

[52] U.S. Cl. ..... 315/39.71; 315/5.34; 315/39.51; 335/217

[51] Int. Cl.[2] ..... H01J 25/50

[58] Field of Search ..... 315/39.71, 5.34, 39.51; 335/217

[56] References Cited

UNITED STATES PATENTS

| | | | |
|---|---|---|---|
| 2,964,670 | 12/1960 | Bliss | 315/3.5 |
| 3,061,754 | 10/1962 | Kajihara | 315/39.51 X |
| 3,346,766 | 10/1967 | Feinstein | 315/39.71 |
| 3,376,466 | 4/1968 | Gerard | 315/39.71 |
| 3,855,498 | 12/1974 | MacMaster et al. | 315/39.71 |
| 3,881,127 | 4/1975 | MacMaster et al. | 315/39.71 |

*Primary Examiner*—Saxfield Chatmon, Jr.
*Attorney, Agent, or Firm*—Staas & Halsey

[57] ABSTRACT

A core type magnetron is disclosed wherein a permanent magnet is provided in an anode resonator surrounding a cathode, characterized in that said permanent magnet has a reversible temperature coefficient of which is variable depending on the operating point and which is adapted such that it is utilized at the operating point where said reversible temperature coefficient has the value of zero or close thereto.

3 Claims, 3 Drawing Figures

FIG. 1
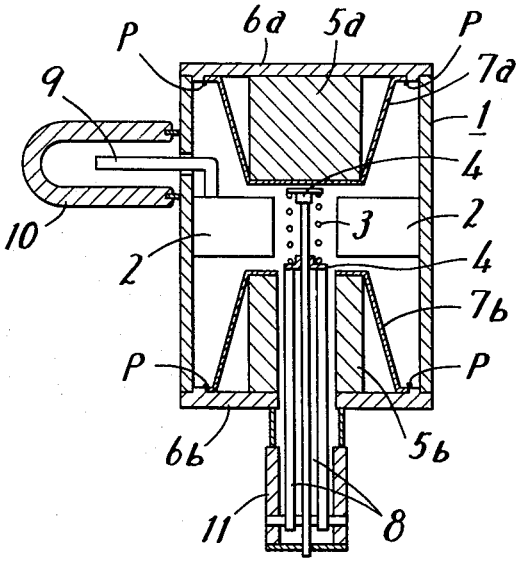
FIG. 2
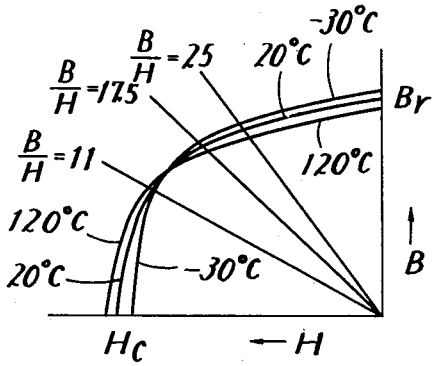
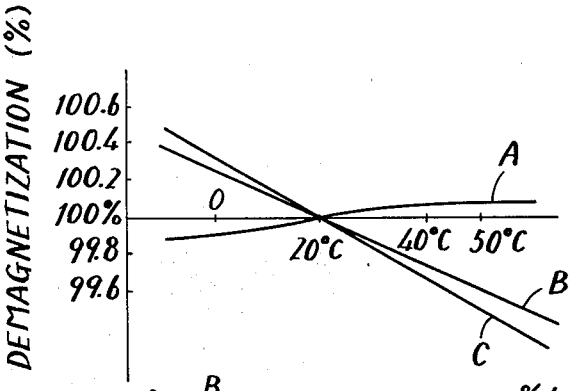
FIG. 3
A --- $\frac{B}{H} = 11$ +0.005 ~ -0.002 %/c
B --- $\frac{B}{H} = 17.5$ -0.0135 %/c
C --- $\frac{B}{H} = 25$ -0.017 %/c

CORE MAGNETRON MAGNETIC CIRCUIT HAVING A TEMPERATURE COEFFICIENT APPROXIMATELY ZERO AND PERMEANCE RELATED

BACKGROUND OF THE INVENTION:

1. Field of the Invention

The present invention relates to a magnetron, and more specifically to an improvement in a core type magnetron.

2. Description of the Prior Art

In order for a magnetron to oscillate at the rated frequency and output, the prescribed high voltage and the prescribed magnetic field must be applied. Application of the prescribed high voltage can be readily performed by controlling an electric circuit connected to a constant voltage supply. However, application of the prescribed magnetic field has been recently effected by means of a permanent magnet, which cannot provide a normally constant magnetic field, since it is influenced by the ambient temperature. More specifically, a cast magnetic material such as alnico-5 or a ferrite magnetic material has been used as a permanent magnet in prior art magnetrons. The reversible temperature variation coefficient of alnico-5 magnet is −0.021%/°C and that of ferrite magnet is 0.18%/°C. As is well known, the reversible temperature coefficient is temperature dependent in the case of residual magnetic flux density (Br) and varies irrespective of the operation point of the magnet. In other words, such magnets are demagnetized with an increase of temperature.

In a magnetron, the anode cylinder thereof is elevated to 350° – 400° C due to the heat caused by the anode loss, a cathode heater and the like during the oscillation thereof. Therefore, in case of the employment of a ferrite magnet the magnetic field is considerably decreased at that temperature elevation, with the result that the oscillation frequency fluctuates and the output undesirably varies. Therefore, in designing conventional magnetrons, consideration has been given to preventing the temperature of the magnet from being increased, to thereby prevent the magnet from being demagnetized by an increase in temperature. Thus, conventional magnetrons were of a shell type, wherein a magnet is provided outside and spaced from the anode cylinder. However, shell type magnetrons have the disadvantage of being large in size, which necessarily causes and the magnetc path, for providing a magnetic field to the operation space within the anode resonator, to become long and increase the possibility of flux leakage.

Core type magnetrons comprising a magnet housed inside the anode cylinder have a much shorter magnetic path and can be made much smaller in size. Nevertheless, the core type magnetrons have heretofore been impractical to use because of the large amount of demagnetization which occurs due to an increase in the temperature of the magnet.

SUMMARY OF THE INVENTION

Briefly stated, the present invention comprises a core type magnetron wherein a permanent magnet is provided in an anode resonator surrounding a cathode. Furthermore the present invention is characterized in that the permanent magnet has a reversible temperature coefficient which is variable depending on the operating point and which is adapted such that it is utilized at the operating point where said reversible temperature coefficient has the value of zero or close thereto.

Therefore, a principal object of the present invention is to enable practical use of a core type magnetron by employing a new permanent magnet and by properly selecting the operation point thereof.

This object and other objects, features, aspects and advantages of the present invention will be better understood when taken in conjunction with the detailed description made in the following with reference to the accompanying drawings.

BRIEF DESCRIPTION OF THE DRAWINGS

FIG. 1 is a sectional view of a magnetron in accordance with the present invention, FIG. 2 is a graph showing a demagnetization characteristic curve of the permanent magnet for use in the present invention, and FIG. 3 is a graph showing variation of the reversible temperature of the magnet.

DESCRIPTION OF THE PREFERRED EMBODIMENT

The magnet of the present invention uses, for example, electrolytic iron, electrolytic cobalt, electrolytic chromium and a metallic silicon material, which are melted in a high frequency induction furnace and cast in the atmosphere. The composition is then subjected to hot working at about 1150° C and then cold working, whereby a kind of rolled magnet is formed. Such a magnet is commercially available by the name of CKS magnet (manufactured by Sumitomo Special Metal Industries, Ltd.).

The demagnetization curve of the CKS magnet is shown in FIG. 2, in which the ordinate indicates the magnetic flux density (B) and the abscissa indicates the magnetic field intensity (H). Referring to FIG. 2, several demagnetization curves are plotted, with temperature (−30° C, 20° C and 120° C) parameters. As seen from the curves in FIG. 2, the demagnetization curve is different from the conventional cast magnet and the like discussed in the description of the prior art. More specifically, the said CKS magnet shows a decrease in the residual magnetic flux density and an increase in coersive force at the higher temperature. The CKS magnet also shows an increase in the residual magnetic flux density and a decrease in the coersive force at the lower temperature.

When the magnet is placed in a core type magnetron, a magnetic circuit is formed to include the magnet and the structure of the magnetron. The reluctance of the magnetic circuit is determined and accordingly a permeance of the magnetic circuit is determined. The slope, as determined by B/H is called a permeance line. The intersection of the permeance line with a demagnetization curve is defined as an operating point of the magnet, inasmuch as the magnetic circuit thus formed operates at the said operating point.

A conventional magnet employed in a conventional core type magnetron shows a decreasing change in the magnetic flux density and thus a change of the magnetic flux in accordance with an increasing change in temperature. More specifically, with the conventional magnet, the temperature coefficient in the demagnetization characteristic does not vary even if the operating point of the magnet is changed. As a result, the magnet is demagnetized as the temperature thereof increases.

According to the present invention, a magnet is utilized in an improved core type magnetron that possesses the magnetization characteristic in which the temperature coefficient in the demagnetization characteristic is varied as a permeance line is changed and thus the operating point is changed, and preferably the variation of the temperature coefficient in the demagnetization characteristic is reversed at a given point.

Referring again to FIG. 2, with the magnet of the example shown, the temperature coefficient of the demagnetization curve is changed as a permeance line is changed, and variation of the temperature coefficient is reversed in the vicinity of the permeance value B/H = 11 by way of a critical point. When the magnetic circuit, including the magnet in question, is designed such that the permeance line extends in the vicinity of the said reversing point of the variation of the temperature coefficient the operating point of the magnetic circuit is at the reversing point. It follows, therefore, that the operating point of the magnet will not vary due to variation of the temperature and thus the magnetic flux in the magnetic circuit will also not change. Therefore, the oscillation frequency and the output level of the magnetron comprising the magnet does not fluctuate due to the variation of the temperature.

FIG. 3 is a graph showing the relation between demagnetization and temperature, with the permeance lines as a parameter, plotted based on the illustration in the FIG. 2 curves, with the temperature 20° C as the reference point. In FIG. 3, the ordinate indicates the demagnetization of the magnet in terms of the percentage, while the abscissa indicates the temperature. As seen from FIG. 3, when a magnet having a demagnetization characteristic curve such as is shown in FIG. 2, is employed in a core type magnetron and the magnetic circuit thereof is designed such that the permeance line comes in the vicinity of the point where the relative demagnetization is minimal with respect to the variation of the temperature, the temperature coefficient is approximately zero. Thus, an improved magnetron is provided wherein the change of the magnetic flux of the permanent magnet is minimal, with respect to the variation of the temperature, and the fluctuation of the oscillation frequency and the output level is accordingly minimal.

With simultaneously reference to FIGS. 2 and 3, the temperature coefficient in the demagnetization characteristic of the said CKS magnet is −0.043%/°C on the ordinate of the magnetic flux density (Br), which is larger than that of an alnico type magnet, and the temperature coefficient varies when the permeance line is changed and accordingly the operating point is varied from the ordinate toward the abscissa. More specifically, the temperature coefficient is −0.017%/°C in case where the permeance line B/H is 25, which is close to the ordinate, and varies to −0.0135%/°C in the case where the permeance value B/H is 17.5. The temperature coefficient becomes +0.005 −0.002%/°C in case where the permeance value B/H becomes 11, which is rather closer to the abscissa, wherein the variation of the temperature coefficient becomes approximately zero when a predetermined temperature say about 50° C, is exceeded. Thus, it is understood that the temperature coefficient can be set to approximately zero by properly selecting the permeance value of the magnetic circuit which is comprised of the said permanent magnet and accordingly by properly setting the operating point of the magnet. Therefore, when the said CKS magnet is used in a core type magnetron such that the permeance line of the magnetic circuit and thus the operating point of the magnet are in the vicinity of the point where the temperature coefficient is approximately zero, an improved magnetron is provided wherein changes to the magnetic flux applied in the operating space in the magnetron are minimal with respect to the variation of the temperature and thus the fluctuations in the oscillation frequency and output level of the magnetron are accordingly minimal, as described previously.

Now description will be made of an embodiment of the magnetron using the above described magnet with reference to FIG. 1. The magnetron comprises an anode cylinder 1, which is made of a magnetic material such as Fe to provide a magnetic path as well as a vacuum enclosure wall. A plurality of conductive vanes 2 of a material such as copper are fixed radially, by brazing, to the inside wall of the said cylinder 1. A direct heat type coil shaped cathode 3 is positioned in the operating space surrounded by vanes 2 and is supported by a pair of end hats 4. A pair of permanent magnets 5*a* and 5*b* are housed in the anode cylinder 1 to provide magnetic energy to the operating space. The permanent magnets 5*a* and 5*b* are fixed magnetically and mechanically to the inner surface of a pair of magnetic end plates 6*a* and 6*b*. The magnetic end plates 6*a* and 6*b* enclose the opposite end openings of the anode cylinder 1 to form another portion of the vacuum envelope wall.

More specifically, the magnets 5*a* and 5*b* are placed on the inner surface of the respective magnetic end plates 6*a* and 6*b* and are covered with fixing caps 7*a* and 7*b*. The caps 7*a* and 7*b* are made of non-magnetic material, such as molybdenum, copper or the like and are fixed to the magnetic end plates 6*a* and 6*b* by means of spot welding (arc welding) P in place along the periphery thereof. One said magnet 5*b* is formed to have an aperture to allow a support/lead bar 8 of the cathode 3 to extend therethrough. Accordingly, the top portion of the fixing cap 7*b*, for fixing the magnet 5*b* is also formed with an aperture. An output antenna 9 is coupled to one of the vanes 2 and extends outside the cylinder through an opening formed in the cylinder 1. A dome 10 such as glass, is provided surrounding the antenna 9 to protect the antenna end tip.

A magnetic path is formed by the three members, i.e. paired magnets 5*a* and 5*b*, paired end plates 6*a* and 6*b* and anode cylinder 1, whereby predetermined magnetic energy is provided to the operating space. The enclosed portion of the magnetron defined by the anode cylinder 1, paired end plates 6*a* and 6*b*, dome 10 for protecting the antenna, and stem 11 enclosing the lead bar, is vacuumized. The said permanent magnet is so dimensioned in height and in diameter that the magnetic field of about 2000 gauss is applied to the operating space and the operating point is achieved where the temperature coefficient may be zero or a value close thereto.

According to the present invention, the permanent magnet is provided wherein the reversible temperature coefficient varies depending on the variation of the magnet operating point and use is made at the operating point where the temperature coefficient is zero or has a value close thereto. Therefore, even if the magnet is housed inside the anode cylinder and the temperature thereof is considerably increased, variation of the magnetic field applied to the operating space is very small, with the result that stabilized oscillation can be achieved and the so called core type magnetron can be put to practical use, to provide a magnetron of a simple structure.

Although this invention has been described and illustrated in detail, it is to be clearly understood that the same is by way of illustration and example only and is not to be taken by way of limitation, the spirit and scope of this invention being limited only by the terms of the appended claims.

What is claimed is:

1. A core type magnetron, comprising a permanent magnet in an anode resonator portion of said magnetron arranged surrounding a cathode portion, a magnetic circuit including said permanent magnet, wherein said permanent magnet has a temperature coefficient which is variable and dependent on the value of said magnetic circuit permeance, and said magnetic circuit is adapted such that said permanent magnet is utilized at the value of permeance of said magnetic circuit where said temperature coefficient is approximately zero.

2. A core type magnetron comprising an anode resonator, a cathode, and a structure providing a magnetic flux conducting path, said anode resonator including a permanent magnet surrounding said cathode and connected to said structure to form a magnetic circuit having a predetermined permeance value, said permanent magnet having a temperature coefficient dependent upon said permeance value and said permeance value being predetermined to make said temperature coefficient approximately equal to zero.

3. A core type magnetron comprising a housing for providing a magnetically conducting path, a variable temperature coefficient permanent magnet within said housing, forming therewith a magnetic circuit having a predetermined permeance value, said variable temperature coefficient of said permanent magnet having a value dependent on said permeance value and said permeance value being predetermined to set said temperature coefficient approximately equal to zero.

* * * * *

UNITED STATES PATENT AND TRADEMARK OFFICE

CERTIFICATE OF CORRECTION

PATENT NO. : 4,027,194

DATED : May 31, 1977

INVENTOR(S) : Masaru Yamano and Toshio Iemura

It is certified that error appears in the above-identified patent and that said Letters Patent are hereby corrected as shown below:

Column 1, line 49, delete "and"; change "magnetc" to -- magnetic --.

Column 3, line 46, change "simultaneously" to -- simultaneous --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*